United States Patent [19]

Jilla

[11] 3,949,124

[45] Apr. 6, 1976

[54] METHOD FOR TREATING TEXTILE MATERIALS AND TEXTILE MATERIALS TREATED IN SUCH A WAY, AND TEXTILE TREATING COMPOSITIONS

[75] Inventor: Dara Ardeshir Jilla, Collinsville, Va.

[73] Assignee: HCA-Martin, Inc., Martinsville, Va.

[22] Filed: July 12, 1974

[21] Appl. No.: 488,068

[52] U.S. Cl. ..... 428/96; 57/140 C; 252/8.6; 427/315; 427/316; 427/390; 428/375; 428/392; 428/394

[51] Int. Cl.[2] D03D 27/00; D04H 11/00; D05C 17/00

[58] Field of Search ..... 428/96, 97, 375, 392, 394; 252/8.6; 57/140 C, 153, 157 AS, 164; 427/299, 315, 316, 372, 384, 390

[56] References Cited

UNITED STATES PATENTS 3,753,772 8/1973 Cohen ..... 428/96

*Primary Examiner*—Marion E. McCamish

*Attorney, Agent, or Firm*—Stevens, Davis, Miller & Mosher

[57] ABSTRACT

There are provided novel antistatic carpet yarns and carpets as well as novel compositions of matter and methods for the chemical treatment of carpet yarns and carpets in order to impart to such textile materials substantially durable hydrophilic, soil-repellency and antistatic properties that will be retained despite rigorous exposure to washing, foam, vacuum and steam cleaning, and wear under high compression loads (or foot-traffic), without any adverse effect on dyestuffs or flammability. The method consists essentially in first treating the carpet yarn or carpet made of preferably synthetic fiber material (by such per se well known methods as padding, spraying or transfer-roll) with an aqueous emulsion which forms a normally solid coating consisting essentially of:

a. at least one phase of an alkylphenol which is insoluble in water and which is dissolved in an alcohol, a ketone, or other organic solvent;

b. at least one phase of a copolymer of dimethyl terephthalate with a tetrol compound having the general formula:

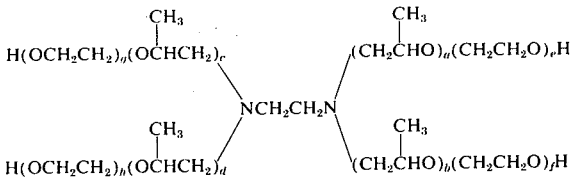

where $a$, $b$, $c$, $d$, $e$, $f$, $g$, and $h$ are each integers and the total of $a$, $b$, $c$, and $d$ is between 8 and 850 and the total of $e$, $f$, $g$, and $h$ is between 8 and 1,000; which is relatively insoluble in water and which is dissolved in an alcohol, a ketone, or other organic solvent;

c. at least one phase of a reaction product of an organic diisocyanate and polyethylene glycol or other polyalkylene glycol which is relatively insoluble in water and which is dissolved in an alcohol, a ketone or other organic solvent;

d. at least one phase of a fluorochemical compound dispersed in water which is insoluble in water and which contains a fluorinated aliphatic radical with at least three carbon atoms, said compound having at least a main transition temperature in excess of approximately 45° C;

e. at least one phase of an acrylic copolymer dispersed in water which is insoluble in water and which is derived from polymerizable monomers, whereby the acrylic copolymer compound has at least a main transition temperature in excess of approximately 45° C; and f. at least one phase of a compound dispersed in water which contains a cross-linkable, water-dispersible polyester and an amino resin which cross-link under the influence of applied heat to form a water-insoluble film, said film having at least a main transition temperature in excess of approximately 45° C, whereby at least one of the said phases is continuous; followed by heat treatment under dry heat for 10 seconds to 10 minutes at 100° to 200° C. The heat treatment step completes the chemical reaction between the above-mentioned phases, while at the same time effecting substantially complete removal of the alcohol, ketone or other organic solvent from the treated textile material.

10 Claims, No Drawings

METHOD FOR TREATING TEXTILE MATERIALS AND TEXTILE MATERIALS TREATED IN SUCH A WAY, AND TEXTILE TREATING COMPOSITIONS

The present invention relates to the treatment of textile materials made of synthetic fibers with a view of imparting to said textile materials excellent hydrophilic, soil-repellency and antistatic properties, thereby overcoming their propensity for accumulating static electrical charges and at the same time making the imparted properties highly durable and long lasting.

Synthetic fibers, such as those made from polyamide, polyester, polyacrylonitrile, modacrylic, polyolefine, aramid aromatic polyamide, etc., possess favorable physical properties which make them desirable for employment in textile manufacturing. Textiles manufactured from these synthetic fibers, however, exhibit an inordinate capacity for accumulating surface charges of static electricity. This characteristic makes them extremely difficult and unwieldy to manipulate and handle during various textile manufacturing operations and use applications. For example, the occurrence of electrostatic discharges from carpets is well known. Under certain atmospheric conditions a person walking over a carpet will generate an electrostatic charge over his body and may experience an uncomfortable or even painful shock on subsequent grounding. The problem arises because the electrical conductivity of the types of synthetic fiber commonly used in carpet pile is very poor, particularly when the atmospheric humidity is low. Furthermore, electrostatic charges produce two effects obvious to all--shocks and dust attraction and retentivity, the latter causing the carpets to become dirty more quickly.

The treatment of carpet yarns and carpets of synthetic fibers with various chemical compounds or compositions in order to obtain hydrophilic, soil-repellency and antistatic properties has been known in the technical world for some time, but treatments have not been commercially available which would impart to such fibers both wash-fast hydrophilic properties and wash-fast anitstatic properties as more fully explained in Kirk-Othmer's Encyclopedia of Chemical Technology, Second Edition, Volume 2, pages 654–665. In addition, the said treatment of fibers and pile fabrics used in carpet manufacture with various chemical compounds or compositions could not be carried out in many cases, since due to the heavy wear or foot-traffic under high compression loads, multiple shampooing, vacuum and steam cleanings to which such fibers and pile fabrics are normally subjected, the hydrophilic and antistatic properties are soon lost again.

The treatment of textile materials with fluorochemical compounds and compositions in order to obtain dry dirt-resistant as well as stain-repellent properties and whose effects will be lasting to the heavy wear, foam and vacuum cleaning and washing of carpets has been known in the technical world for several years, as more fully described in Kirk-Othmer's Encyclopedia of Chemical Technology, Second Edition, Volume 22, pages 145–8. The various types of said treatment with fluorochemical compounds and compositions in accordance with the state of technology to date, although satisfactory for dry dirt-resistant and stain-repellent properties, do not provide carpet yarns, carpets and carpet runners with any antistatic properties, nor in particular, against the generation of electrostatic charges when a person walks over a carpet under low atmospheric humidity conditions. On the contrary, the fluorochemical treated carpet yarn and carpet show extremely high hydrophobic properties and generate very high electrostatic charges.

The present invention provides novel antistatic carpet yarns and carpets as well as novel compositions of matter and methods for the chemical treatment of carpet yarns and carpets in order to impart to such textile materials substantially durable hydrophilic, soil-repellency and antistatic properties that will be retained despite rigorous exposure to washing, foam, vacuum and steam cleaning, and wear under high compression loads (or foot-traffic), without any adverse effect on dyestuffs or flammability. This chemical treatment also results in excellent thermal stability with respect to the temperatures encountered during carpet manufacturing, and particularly during the application of the secondary backing and the latex adhesive curing operations. This chemical treatment can be used in the case of different carpet types -- such as, e.g., when employing synthetic fibers made of polyamide, polyester, polyacrylonitrile, modacrylic, polyolefine, aramid aromatic polyamide, and their combinations.

Additional objects of the invention will become apparent as the description proceeds.

The novel process of the present invention consists essentially in first treating the carpet yarn or carpet made of synthetic fiber material (by such per se well known methods as padding, spraying or transfer-roll) with an aqueous emulsion which forms a normally solid coating consisting essentially of:

a. at least one phase of an alkylphenol which is insoluble in water and which is dissolved in an alcohol, a ketone, or other organic solvent;

b. at least one phase of a copolymer of dimethyl terephthalate with a tetrol compound having the general formula:

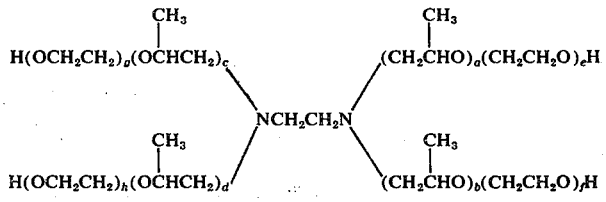

where $a$, $b$, $c$, $d$, $e$, $f$, $g$, and $h$ are each integers and the total of $a$, $b$, $c$, and $d$ is between 8 and 850 and the total of $e$, $f$, $g$, and $h$ is between 8 and 1,000; which is relatively insoluble in water and which is dissolved in an alcohol, a ketone, or other organic solvent;

c. at least one phase of a reaction product of an organic diisocyanate and polyethylene glycol or other polyalkylene glycol which is relatively insoluble in water and which is dissolved in an alcohol, a ketone or other organic solvent;

d. at least one phase of fluorochemical compound dispersed in water which is insoluble in water and which contains a fluorinated aliphatic radical with at least three carbon atoms, said compound having at least a main transition temperature in excess of approximately 45° C;

e. at least one phase of an acrylic copolymer compound dispersed in water which is insoluble in water and which is derived from polymerizable monomers, whereby the acrylic copolymer compound has at least a main transition temperature in excess of approximately 45° C; and f. at least one phase of a compound dispersed in water which contains a cross-linkable, water-dispersible polyester and an amino resin which cross-link under the influence of applied heat to form a water-insoluble film, said film having at least a main transition temperature in excess of approximately 45° C, whereby at least one of the said phases is continuous; followed by heat treatment under dry heat for 10 seconds to 10 minutes at 100° to 200° C. The heat treatment step completes the chemical reaction between the above-mentioned phases, while at the same time effecting substantially complete removal of the alcohol, ketone or other organic solvent from the treated textile material. If desired, the alcohol, ketone or other organic solvent may be recovered from the dryer exhaust.

It appears that the foregoing treatment in some manner forms a normally solid coating that encompasses the fiber and consists of several phases. Without going into any special theory, it is regarded as probable that some of these phases include the alkylphenol, the copolymer of dimethyl terephthalate with the tetrol, and the reaction product of the organic diisocyanate and the polyethylene glycol or other polyalkylene glycol, while the other phases include the fluorinated compounds, the acrylic copolymer, and the modified polyester cross-linked with amino resin. It would appear that these phases may form interlaced networks.

I have discovered that the said treatment in some manner causes the synthetic fiber textile material to acquire remarkable hydrophylic, soil-repellency and antistatic properties which will be retained despite rigorous exposure to washing, foam, vacuum and steam cleaning, and wear under high compressive loads (or foot-traffic).

I have also discovered that upon pre-treating a carpet yarn or carpet or other textile material made of polyamide fiber material with a special aqueous solution or printing paste comprising condensation products of (1) formaldehyde, and (2) naphthalene-sulfonic acid, phenol, sulfonated phenol, diaryl sulfone, urea, melamine, or dicyandiamide on a continuous roll by such per se well known methods as padding, printing or cascading followed by per se well known methods of fixation by steam or dry heat at a temperature between 100° C and 200° C for a period of 20 seconds to 20 minutes, rinsing with clear water and preferentially but not necessarily drying, and then treating the thus-pretreated textile material with the said aqueous emulsion of (a) an alkylphenol, (b) a copolymer of dimethyl terepthalate with a tetrol, (c) a reaction product of an organic diisocyanate and polyethylene glycol or other polyalkylene glycol, (d) a fluoro-chemical compound, (e) an acrylic copolymer, and (f) a compound containing cross-linkable water-dispersible polyester and amino resin, followed by another heat treatment under dry heat for 10 seconds to 10 minutes at 100° to 200° C, optimum results occur in some manner not fully understood with respect to imparting desirable antistatic properties to the thus-treated textile material.

The water-insoluble alkylphenols useful in the present invention are per se known compounds and some are commercially available, for example, nonyl phenol and dodecyl phenol. Higher alkyl (e.g., $C_{8-12}$ alkyl) phenols are in general preferred.

Copolymers of dimethyl terephthalate with tetrols are commercially available (BASF-Wyandotte) under the trade designation ES-7192, said copolymers having an average molecular weight of about 44,000, with the ethylene oxide moiety making up about 55% of the molecular weight. Also, tetrol compounds are commercially available (BASF-Wyandotte) under the trademark Tetronic as a series of poly(oxyethylene)-poly(oxypropylene block copolymers having molecular weights from about 1,650 to over 26,000.

Reaction products of an organic diisocyanate, for example, tolylene diisoyanate, diphenylmethane-4,4-diisoyanate, etc. and polyethylene glycols or other polyalkylene glycols which are relatively insoluble in water are per se known compounds and some are commercially available, for example, polyethylene glycol tolylene diisocyanate.

Polyethylene glycols and other polyalkylene glycols useful in the present invention are known compounds and are commercially available (Union Carbide) under the trademark Carbowax and Ucon Lubricants, respectively.

Fluorochemical compounds insoluble in water suitable for textiles which are non-adhesive and non-gummy are commercially available (du Pont and 3M) under the trademark Zepel and Scotchgard, respectively, as a series of clear, colorless, film-forming fluorinated compounds in aqueous dispersions, which are produced when polymerizing (addition or condensation polymerization) or copolymerizing one or several suitable monomers, such as, e.g., $C_8F_{17}S0_2N(CH_2CH_2OH)_2$, $C_8F_{17}SO_2N(CH_2CH_2SH)_2$, $C_8F_{17}SO_2N(CH_2CH_2CO_2H)_2$ and $C_8F_{17}SO_2N(CH_2CH_2NH_2)_2$. Also usable are compounds belonging to any series with fluorinated groups between $C_3F_7$ and approximately $C_{20}F_{41}$. At least one main transition temperature, namely, glass transition temperature (Tg) or the crystal melting point (Tm) as usually determinable by means of differential thermal analysis (DTA) of the fluorochemical compound must remain above approximately 45°C in order to be resistant also at high compression loads against dirt and especially dirt formed of small particles in carpets.

Acrylic copolymers suitable for textiles which are non-adhesive and non-gummy (or are age-hardenable to a non-gummy state) are commercially available (Rohm & Haas) under the trademark Rhoplex and under the designation "Experimental Emulsions" as a series of clear, colorless, film-forming, self-crosslinking acrylic copolymer compounds in aqueous dispersions, which are produced from suitable monomers such as, e.g., vinyl fluoride, vinylidene fluoride, vinyl chloride, vinylidene chloride, alpha methyl styrene, lower alkyl methacrylates, glycidyl acrylate and methacrylate, polymerized or copolymerized together or with small amounts of additional monomers, such as, e.g., vinyl acetate, vinyl pyridine, alkyl acrylate and alkyl methacrylates, acryl amides, itaconic and maleic acids. The amounts of additional monomer used in this way must not be, of course, so large as to make the acrylic copolymer water-soluble. And likewise at least one main transition temperature, namely, glass transition temperature (Tg) or the crystal melting point (Tm) as usually determinable by means of differential thermal analysis (DTA) of the acrylic copolymer compound must remain above approximately 45°C in order to be resistant also at high compression loads against dirt and especially dirt formed of small particles in carpets.

Mixtures of polyester and amino resin in aqueous dispersion are commercially available (Eastman Chemical Products) under the designation Polyester Binders as a series of compounds which are susceptible of cross-linking under the influence of applied heat to form water-insoluble, tough, clear, colorless, flexible films. These compounds are produced from suitable cross-linkable, water-dispersible polyesters, such as, e.g., reaction products of glycols, poly(ethylene glycol) or mixtures thereof with dimethylsodiumsulfoisophthalic and dicarboxylic acids or mixtures thereof with suitable water-dispersible amino resins, such as, e.g., urea-formaldehyde and melamine-formaldehyde. Suitable glycols are, for example, diethylene glycol and triethylene glycol. Suitable dicarboxylic acids are, for example, isophthalic and adipic acids. At least one main transition temperature, namely, glass transition temperature (Tg) or the crystal melting point (Tm) of the said film must remain above approximately 45°C.

Suitable alcohols are, for example, isopropanol, ethanol, methanol, etc.

Suitable ketones are, for example, methyl ethyl ketone, acetone, methyl isobutyl ketone, etc.

Suitable organic solvents are, for example, dimethyl formamide, dimethyl acetamide, dimethyl sulfoxide, etc.

The invention will now be still further explained with the aid of the following examples, where if nothing else is mentioned to the contrary, all parts and percentages indicate parts and percentages by weight.

EXAMPLE 1

10 Parts nonyl phenol, 40 parts of the copolymer ES-7192 (molecular weight 44,000, with the ethoxy moieties making up 55% of the molecular weight), 10 parts of polyethylene glycol tolylene diisocyanate and 140 parts of isopropanol were placed in a flask provided with stirrer. The contents of the flask were mixed under intense stirring for 60 minutes at 50° C so as to form a stable solution.

Then an emulsion was made up from the 200 parts of the stable solution, 50 parts of the fluorinated polyacrylic compound Zepel, 25 parts of the acrylic copolymer compound, a copolymer of butylacrylate and vinylidene chloride, which is sold by Rohm & Haas under the designation E-801N, 25 parts of the sodium salt of isophthalic acid-amino resin compound, which is sold by Eastman Chemicals under the designation WDX-743, and 700 parts deionized water, by mixing these components in a suitable flask provided with stirrer. The flask contents were mixed under intense stirring for 30 minutes at ambient temperature so as to form a relatively stable emulsion.

A skein of space dyed polyester staple carpet yarn was then gently sprayed with the above-mentioned aqueous emulsion in accordance with the present invention so that the wet absorption amounted to 25% of the weight of the carpet yarn. The polyester carpet yarn was then heated for 60 seconds at 190° C. Polyester carpet yarn treated in this way then shows a durable coating imparting hydrophilic, soil-repellency and antistatic properties which remains effective even after the carpet yarns have been washed or cleaned several times and subjected to heavy wear. Such a result was impossible hitherto with the conventional treatment methods.

The advantages of treatment of carpet yarns with compositions in accordance with the present invention will be further described below on the basis of detailed examples.

The surface electrical resistivity, which influences the degree of accumulation of electrostatic charges and, therefore, provides a good measure of the antistatic (electrostatic) properties of a textile yarn, was then tested according to the AATCC Test Method 84-1973, "Electrical Resistivity of Yarns".

The carpet yarns and treatments were as follows:

Lot 1 — untreated comparison carpet yarns;

Lot 2 — carpet yarns treated with the novel compositions in accordance with Example 1 above;

Lot 3 — carpet yarns treated in accordance with Example 1 but without the addition of the nonyl phenol, copolymer ES-7192 and the polyethylene glycol tolylene diisocyanate in the aqueous emulsion.

The tests as initially carried out showed that the carpet yarns of Lot 2 were superior to those of Lots 1 and 3 in regard to antistatic properties.

Table I

| Lot | Half-Life of Charge Dissipation (a), seconds | Electrical Resistivity (a), ohms | Electrical Conductance (a), LED Antistatic Indicator Circuit - Sound & Light Display: LED Triggered | LED not Triggered |
|---|---|---|---|---|
| 1 | >200 | $4 \times 10^{14}$ | | x |
| 2 | 5 | $<10^{9}$ | x | |
| 3 | >200 | $>10^{15}$ | | x |

a. 25% Relative Humidity, 24° C.

The charge dissipation data were obtained using a Rothschild Voltmeter, available through Heberlein, Inc., Greenville, South Carolina.

The electrical resistivity data were obtained using a PASCO 525 Electrostatic Measuring System, available through PASCO Scientific, San Leandro, California 94577. This instrument measures electrical resistivity in the range $10^9$ ohms to $10^{15}$ ohms.

The electrical conductance was demonstrated using a B & L DigiStat, available through B & L Electronic Specialties, Hickory, North Carolina 28601. Antistatic textiles trigger an LED (Light Emitting Diode) indicator circuit with sound and light display; whereas ordinary textiles which do not conduct electricity do not trigger the LED circuit.

All carpet yarns were then subjected to a shampooing test according to the AATCC Test Method 138-1972, "Shampooing-Washing of Textile Floor Coverings", and the AATCC Test Method 107-1972, "Colorfastness to Water". Several loop, cut-pile and shag carpets were made of the above-mentioned Lots 1, 2 and 3 carpet yarns, respectively, with a weight per unit area of 40 oz. pile/sq. yd. These tests were repeated 3 times. The test results are summarized in Table II.

Table II

| Lot | Half-Life of Charge Dissipation, Seconds After AATCC 138-1972 | 107-1972 | Electrical Resistivity ohms After AATCC 138-1972 | 107-1972 | Electrical Conductance LED Antistatic Indicator Circuit - Sound & Light Display After AATCC 138-1972 | 107-1972 |
|---|---|---|---|---|---|---|
| 1 | >200 | >200 | $4.5 \times 10^{14}$ | $>10^{14}$ | LED not triggered | LED not triggered |
| 2 | 20 | 7 | $4.0 \times 10^{9}$ | $<10^{9}$ | LED triggered | LED triggered |
| 3 | >200 | >200 | $2.0 \times 10^{14}$ | $>10^{14}$ | LED not triggered | LED not triggered |

All carpet samples were then subjected to a running test according to the AATCC Test Method 122-1973, "Carpet Soiling: Service Soiling Method". The test results are summarized in Table III:

Table III

| Lot | Half-Life of Charge Dissipation (a), Seconds | Electrical Resistivity (a), ohms | Electrical Conductance (a), LED Antistatic Indicator Circuit - Sound & Light Display LED Triggered | LED not Triggered | Visual Rating of Cleanness (b) |
|---|---|---|---|---|---|
| 1 | >200 | $4.0 \times 10^{14}$ | | x | 1.0 |
| 2 | 16 | $<10^{9}$ | x | | 3.8 |
| 3 | >200 | $>10^{15}$ | | x | 3.4 |

b. AATCC Test Method 121-1973, "Carpet Soiling: Visual Rating Method".
5 = no difference from clean standard
1 = largest difference in the reference scale.

EXAMPLE 2

A paste containing the following components was prepared:

| | |
|---|---|
| Formaldehyde-added phenol sulfonic acid mixture | 25 cc. |
| Benzyl alcohol (commercial) | 6 cc. |
| Sulfuric acid (concentrated) | 0.05 cc. |
| "Lyogen" V(U) (a commercial wetting agent, an ethylene oxide condensate) | 0.05 cc. |
| "Kelzan" (a commercial thickener or printing gum, a xanthan gum) | 1.0 gram |
| Water | 218.9 cc. |

A skein of space dyed, continuous filament, multi-filament nylon carpet yarn was printed (i.e., pre-treated) at ambient temperature with this paste, steamed at 100°C for five minutes, rinsed and then dried.

Several skeins of continuous filament, multi-filament nylon carpet yarn, pretreated as just described, were then treated with the treatment mixture of Example 1 by the transfer-roll method at a wet absorption of 25% of the weight of the carpet yarn, and then heated for 60 seconds at 190°C.

The carpet yarns and treatments were as follows:

Lot 1 — untreated comparison carpet yarns;

Lot 2 — carpet yarns treated with the novel compositions, in accordance with Example 2;

Lot 3 — carpet yarns which were treated in accordance with Example 2, but without the addition of the nonyl phenol, the copolymer ES-7192, and the polyethylene glycol tolylene diisocyanate in the aqueous emulsion.

The test results of the initial state, after three repeated tests by the AATCC Test Methods 138-1972 and 107-1972, and after the AATCC Test Method 122-1973, are summarized in Tables IV(A) and IV(B).

Table IV(A)

| Lot | Half-Life of Charge Dissipation, seconds after AATCC Initial | 138-1972 | 107-1972 | 122-1973 | Electrical Resistivity, Ohms after AATCC Initial | 138-1972 | 107-1972 | 122-1973 | Visual Rating Cleanness, after AATCC 122-1973 |
|---|---|---|---|---|---|---|---|---|---|
| 1. | >200 | >200 | >200 | >200 | $7.0\times10^{14}$ | $6.0\times10^{14}$ | $8.0\times10^{14}$ | $8.0\times10^{14}$ | 1.0 |
| 2. | 12 | 30 | 18 | 25 | $<10^{9}$ | $9.0\times10^{9}$ | $2.2\times10^{9}$ | $8.0\times10^{9}$ | 3.6 |
| 3. | >200 | >200 | >200 | >200 | $>10^{15}$ | $>10^{15}$ | $>10^{15}$ | $>10^{15}$ | 3.0 |

Table IV(B)

| Lot | Electrical Conductance 'LED' Antistatic Indicator Circuit - Sound & Light Display after AATCC Initial | 138-1972 | 107-1972 | 122-1973 |
|---|---|---|---|---|
| 1. | 'LED' not triggered | 'LED' not triggered | 'LED' not triggered | 'LED' not triggered |
| 2. | 'LED' triggered | 'LED' triggered | 'LED' triggered | 'LED' triggered |
| 3. | 'LED' not triggered | 'LED' not triggered | 'LED' not triggered | 'LED' not triggered |

EXAMPLE 3

5 Parts of nonyl phenol, 5 parts of dodecyl phenol, 60 parts of the copolymer ES-7192, 20 parts of polyethylene glycol tolylene diisocyanate and 110 parts of methyl ethyl ketone were placed in a flask provided with stirrer. The flask contents were mixed under intense stirring for 60 minutes at 50° C. so as to form a stable solution.

Then an emulsion was made from the 200 parts of stable solution just mentioned, and 50 parts of the fluorinated polyacrylic compound Zepel, 25 parts of the acrylic copolymer which is sold by Rohm & Haas under the trademark Rhoplex E-32, 25 parts of the sodium salt of isophthalic acid compound WDX-743 and 700 parts deionized water. These components were mixed in a flask provided with stirrer. The flask contents were mixed under intense stirring for 30 minutes at ambient temperature so as to form a relatively stable emulsion.

A skein of space dyed, staple acrylic carpet yarn was then padded with the above-mentioned aqueous emulsion in accordance with the present invention so that the wet absorption amounted to 25% of the weight of the carpet yarn. The acrylic carpet yarn was then heated for 60 seconds at 150° C.

The carpet yarns and treatments were as follows:

Lot 1 — untreated comparison yarns;

Lot 2 — carpet yarns treated with the novel compositions in accordance with Example 3

Lot 3 — carpet yarns which were treated in accordance with Example 3 but without the addition of the nonyl phenol, the dodecyl phenol, the copolymer ES-7192 and the polyethylene glycol tolylene diisocyanate in the aqueous emulsion.

The test results of the initial state, after 3 repeated trials of the AATCC Test Methods 138-1972, 107-1972 and after the AATCC Test Method 122-1973 are summarized below in Tables V(A) and V(B):

Table V(A)

| Lot | Half-Life of Charge Dissipation, seconds | | | | Electrical Resistivity, Ohms | | | | Visual Rating Cleanness, after AATCC 122-1973 |
|---|---|---|---|---|---|---|---|---|---|
| | | after AATCC | | | | after AATCC | | | |
| | Initial | 138-1972 | 107-1972 | 122-1973 | Initial | 138-1972 | 107-1972 | 122-1973 | |
| 1. | >200 | >200 | >200 | >200 | $8.5\times10^{14}$ | $7.4\times10^{14}$ | $7.9\times10^{14}$ | $8.1\times10^{14}$ | 1.0 |
| 2. | 9 | 25 | 13 | 17 | $<10^{9}$ | $7.5\times10^{9}$ | $<10^{9}$ | $1.5\times10^{9}$ | 3.8 |
| 3. | >200 | >200 | >200 | >200 | $>10^{15}$ | $9.5\times10^{14}$ | $>10^{15}$ | $>10^{15}$ | 3.0 |

Table V(B)

| Lot | Electrical Conductance 'LED' Antistatic Indicator Circuit - Sound & Light Display | | | |
|---|---|---|---|---|
| | | after AATCC | | |
| | Initial | 138-1972 | 107-1972 | 122-1973 |
| 1. | 'LED' not triggered | 'LED' not triggered | 'LED' not triggered | 'LED' not triggered |
| 2. | 'LED' triggered | 'LED' triggered | 'LED' triggered | 'LED' triggered |
| 3. | 'LED' not triggered | 'LED' not triggered | 'LED' not triggered | 'LED' not triggered |

EXAMPLE 4

10 Parts of nonyl phenol, 40 parts of the copolymer ES-7192, 40 parts of polyethylene glycol tolylene diisocyanate, and 110 parts of dimethyl formamide were placed in a flask provided with stirrer. The flask contents were mixed under intense stirring for 60 minutes at 80° C so as to form a stable solution.

Then an emulsion was made from the 200 parts of the stable solution just mentioned, and 60 parts of the fluorinated polyacrylic compound Hepel, 20 parts of the acrylic copolymer E-801N, 20 parts of the sodium salt of isophthalic acid-amino resin compound WDX-743 and 700 parts deionized water. These components were mixed in a flask provided with stirrer. The flask contents were stirred under intense stirring for 30 minutes at ambient temperature so as to form a relatively stable emulsion.

A skein of space dyed, continuous filament multi-filament polypropylene carpet yarn was treated by the transfer-roll method at a wet absorption of 25% of the weight of the carpet yarn, and then heated for 60 seconds at 150° C.

The carpet yarns and treatments were as follows:

Lot 1 — untreated comparison carpet yarn;

Lot 2 — carpet yarns treated with the novel compositions in accordance with Example 4;

Lot 3 — carpet yarns which were treated in accordance with Example 4 but without the addition of the nonyl phenol, the copolymer ES-7192, and the polyethylene glycol tolylene diisocyanate in the aqueous emulsion.

The test results of the initial state, after 3 repeated trials of the AATCC Test Method 138-1972, 107-1972 and after the AATCC Test Method 122-1973 are summarized below in Tables VI(A) and VI(B):

Table VI(A)

| Lot | Half-Life of Charge Dissipation, seconds | | | | Electrical Resistivity, Ohms | | | | Visual Rating Cleanness, after AATCC 122-1973 |
|---|---|---|---|---|---|---|---|---|---|
| | | after AATCC | | | | after AATCC | | | |
| | Initial | 138-1972 | 107-1972 | 122-1973 | Initial | 138-1972 | 107-1972 | 122-1973 | |
| 1. | >200 | >200 | >200 | >200 | $6.8\times10^{14}$ | $4.0\times10^{14}$ | $4.2\times10^{14}$ | $6.5\times10^{14}$ | 1.0 |
| 2. | 11 | 19 | 14 | 28 | $<10^{9}$ | $3.5\times10^{9}$ | $<10^{9}$ | $8.7\times10^{9}$ | 4.0 |

Table VI(A)-continued

| Lot | Half-Life of Charge Dissipation, seconds | | | | Electrical Resistivity, Ohms | | | | Visual Rating Cleanness, after AATCC |
|---|---|---|---|---|---|---|---|---|---|
| | | after AATCC | | | | after AATCC | | | |
| | Initial | 138-1972 | 107-1972 | 122-1973 | Initial | 138-1972 | 107-1972 | 122-1973 | 122-1973 |
| 3. | >200 | >200 | >200 | >200 | $>10^{15}$ | $9.9\times10^{14}$ | $>10^{15}$ | $>10^{15}$ | 3.8 |

Table VI(B)

| Lot | Electrical Conductance 'LED' Antistatic Indicator Circuit - Sound & Light Display | | | |
|---|---|---|---|---|
| | | after AATCC | | |
| | Initial | 138-1972 | 107-1972 | 122-1973 |
| 1. | 'LED' not triggered | 'LED' not triggered | 'LED' not triggered | 'LED' not triggered |
| 2. | 'LED' triggered | 'LED' triggered | 'LED' triggered | 'LED' triggered |
| 3. | 'LED' not triggered | 'LED' not triggered | 'LED' not triggered | 'LED' not triggered |

What is claimed is:

1. Carpet yarn or carpet having lasting hydrophilic, soil-repellency and antistatic properties comprising organic textile fibers having a normally solid coating consisting essentially of:

a. at least one phase of an alkylphenol which is insoluble in water and which is dissolved in an alcohol, a ketone, or other organic solvent;

b. at least one phase of a copolymer of dimethyl terephthalate with a tetrol compound having the general formula:

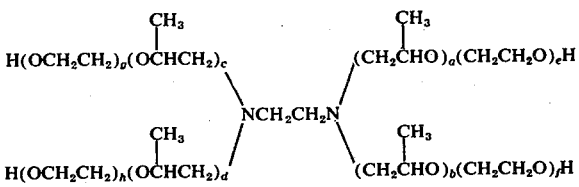

where *a,b,c,d,e,f,g*, and *h* are each integers and the total of *a,b,c*, and *d* is between 8 and 850 and the total of *e,f,g*, and *h* is between 8 and 1,000; which is relatively insoluble in water and which is dissolved in an alcohol, a ketone, or other organic solvent;

c. at least one phase of a reaction product of an organic diisocyanate and polyethylene glycol or other polyalkylene glycol which is relatively insoluble in water and which is dissolved in an alcohol, a ketone or other organic solvent;

d. at least one phase of a fluorochemical compound dispersed in water which is insoluble in water and which contains a fluorinated aliphatic radical with at least three carbon atoms, said compound having at least a main transition temperature in excess of approximately 45° C;

e. at least one phase of an acrylic copolymer dispersed in water which is insoluble in water and which is derived from polymerizable monomers, whereby the acrylic copolymer compound has at least a main transition temperature in excess of approximately 45° C; and f. at least one phase of a compound dispersed in water which contains a cross-linkable, water-dispersible polyester and an amino resin which cross-link under the influence of applied heat to form a water-insoluble film, said film having at least a main transition temperature in excess of approximately 45° C, whereby at least one of the said phases is continuous.

2. Carpet yarn or carpet according to claim 1 wherein the organic textile fibers are present in the form of staple fiber, continuous filament multi-filaments, or pile.

3. Carpet yarn or carpet according to claim 1 wherein the organic textile fibers are synthetic.

4. Carpet yarn and carpet according to claim 3 wherein the organic textile fibers are selected from the group consisting of polyamide, polyester, polyacrylonitrinile, modacrylic, polyolefine, aramid aromatic polyamide fibers, and combinations including such fibers.

5. Carpet yarn or carpet according to claim 1 wherein the said carpet yarn or carpet is first pretreated with an aqueous solution or printing paste of condensation products of (1) formaldehyde and (2) naphthalenesulfonic acid, phenol, sulfonated phenol, diaryl sulfone, urea, melamine, or dicyandiamide, and then exposing same to steam or dry heat at a temperature between 100° C and 200° C for a period of 20 seconds to 20 minutes, rinsing with water and then preferably but not necessarily drying.

6. Carpet yarn or carpet according to claim 5 wherein the organic textile fibers are present in the form of staple fiber, continuous filament multifilaments, or pile.

7. Carpet yarn or carpet according to claim 6 wherein the organic textile fibers are selected from the group consisting of polyamide, polyester, polyacrylonitrinile, modacrylic, polyolefine, aramid aromatic polyamide fibers, and combinations including such fibers.

8. A composition for the treatment of surfaces of textile materials for the purpose of imparting hydrophylic, soil-repellency and lasting antistatic properties under high pressure thereto, said composition comprising:

a. an alkylphenol which is insoluble in water and dissolved in an alcohol, a ketone, or other organic solvent;

b. a copolymer of dimethyl terephthalate with a tetrol compound having the general formula:

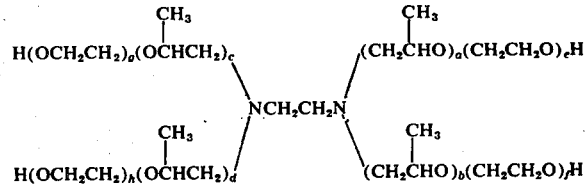

where $a,b,c,d,e,f,g$, and $h$ are each integers and the total of $a,b,c$, and $d$ is between 8 and 850 and the total of $e,f,g$, and $h$ is between 8 and 1,000; which is relatively insoluble in water and which is dissolved in an alcohol, a ketone, or other organic solvent;

c. a reaction product of an organic diisocyanate and polyethylene glycol or other polyalkylene glycol which is relatively insoluble in water and which is dissolved in an alcohol, a ketone or other organic solvent;

d. a fluorochemical compound dispersed in water which is insoluble in water and which contains a fluorinated aliphatic radical with at least three carbon atoms, said compound having at least a main transition temperature in excess of approximately 45° C;

e. an acrylic copolymer dispersed in water which is insoluble in water and which is derived from polymerizable monomers, whereby the acrylic copolymer compound has at least a main transition temperature in excess of approximately 45° C; and f. a compound dispersed in water which contains a cross-linkable, water-dispersible polyester and an amino resin which cross-link under the influence of applied heat to form a water-insoluble film, said film having at least a main transition temperature in excess of approximately 45° C.

9. A method for imparting lasting hydrophylic, soil-repellency and antistatic properties to carpet yarns and carpets comprising:

a. treating same with an aqueous emulsion composition consisting essentially of (1) an alkylphenol insoluble in water and which is dissolved in an alcohol, a ketone, or other organic solvent, (2) a copolymer of dimethyl terephthalate with a tetrol compound which is relatively insoluble in water and which is dissolved in an alcohol, a ketone, or other organic solvent, (3) a reaction product of an organic diisocyanate and polyethylene glycol or other polyalkylene glycol which is relatively insoluble in water and which is dissolved in an alcohol, a ketone, or other organic solvent, (4) a fluorinated compound insoluble in water, (5) an acrylic copolymer which is derived from polymerizable monomers, and (6) a compound containing cross-linkable, water-dispersible polyester and amino resin; and thereafter b. drying the carpet yarn and carpet surface for 10 seconds to 10 minutes at 100° C to 200° C.

10. A method for imparting lasting hydrophylic, soil-repellency and antistatic properties to carpet yarns and carpets according to claim 9 wherein the said carpet yarns and carpets are first pre-treated with an aqueous solution or printing paste of condensation products of (1) formaldehyde and (2) naphthalenesulfonic acid, phenol, sulfonated phenol, diaryl sulfone, urea, melamine, or dicyandiamide, and then exposing same to steam or dry heat at a temperature between 100° C and 200° C for a period of 20 seconds to 20 minutes, rinsing with water and then preferably but not necessarily drying.

* * * * *

UNITED STATES PATENT OFFICE

CERTIFICATE OF CORRECTION

Patent No. 3,949,124 Dated April 6, 1976

Inventor(s) Dara A. Jilla

It is certified that error appears in the above-identified patent and that said Letters Patent are hereby corrected as shown below:

In Example 4, column 10, line 35, for "Hepel" read -- Zepel --.

Signed and Sealed this twenty-ninth Day of June 1976

[SEAL]

*Attest:*

RUTH C. MASON
*Attesting Officer*

C. MARSHALL DANN
*Commissioner of Patents and Trademarks*